US005291952A

United States Patent [19]

Arend

[11] Patent Number: 5,291,952

[45] Date of Patent: Mar. 8, 1994

[54] EXTINGUISHING AGENT CONTAINER

[75] Inventor: Roland Arend, Kettig, Fed. Rep. of Germany

[73] Assignee: Deugra Gesellschaft fur Brandschutzsysteme mbH, Ratingen, Fed. Rep. of Germany

[21] Appl. No.: 935,027

[22] Filed: Aug. 25, 1992

[30] Foreign Application Priority Data

Jul. 22, 1992 [DE] Fed. Rep. of Germany ..... 4224184

[51] Int. Cl.[5] ..... A62C 13/22

[52] U.S. Cl. ..... 169/71; 169/74; 169/84

[58] Field of Search ..... 169/71, 74, 84, 85, 169/28, 58

[56] References Cited

U.S. PATENT DOCUMENTS

| | | | |
|---|---|---|---|
| 2,328,345 | 8/1943 | Keefe | 169/77 |
| 2,417,082 | 3/1947 | Mapes et al. | 169/28 |
| 2,473,349 | 6/1949 | Snowden | 169/85 X |
| 3,552,495 | 1/1971 | Fiero | 169/28 |
| 4,319,640 | 3/1982 | Brobeil | 169/28 |
| 4,328,867 | 5/1982 | Heath | 169/58 |
| 5,031,701 | 7/1991 | McLelland et al. | 169/58 |
| 5,038,866 | 8/1991 | Kern et al. | 169/58 X |

FOREIGN PATENT DOCUMENTS

| | | | |
|---|---|---|---|
| 1443886 | 12/1988 | U.S.S.R. | 169/84 |
| 2083353 | 3/1982 | United Kingdom | 168/58 |

*Primary Examiner*—Andres Kashnikow
*Assistant Examiner*—Gary C. Hoge
*Attorney, Agent, or Firm*—Chilton, Alix & Van Kirk

[57] ABSTRACT

A container for a fire extinguishing or explosion suppressing agent is provided with a pressure responsive, frangible disc which normally closes the outflow orifice for the agent. The container is provided with at least one gas-injection port to which a compressed gas generator is connected. The container is normally in an unpressurized state; and, when the gas generator is activated, the disc will be ruptured during the pressure buildup within the container and the agent will subsequently be ejected from the container by the injected gas.

13 Claims, 2 Drawing Sheets

EXTINGUISHING AGENT CONTAINER

BACKGROUND OF THE INVENTION

1. Field of the Invention

The present invention relates to the dispersal of material, a fire extinguishing agent for example, into an ambient atmosphere and particularly to release into the atmosphere of fire and/or explosion suppressant materials from sealed storage containers. More specifically, this invention is directed to containers for the storage of dry or liquid materials such as fire extinguishing and/or explosion preventative agents, and especially to such containers wherein the stored material will be caused to be ejected from the container and carried into the ambient atmosphere by means of a pressurized propulsive gas in response to the generation of a command signal. Accordingly, the general objects of the present invention are to provide novel and improved methods and apparatus of such character.

2. Description of the Prior Art

While not limited thereto in its utility, the present invention is particularly well suited for use in protective systems and particularly as an aid in explosion suppression or fire protection. It is known in the art to provide, at judiciously selected locations within a structure, storage containers for fire extinguishing and/or explosion preventing agents. For example, in suppression systems for preventing dust and/or gas explosions, pressurized containers filled with an extinguishing agent in powder or liquid form are often provided. These containers are typically pressurized to a level of 60 bar by a nonflammable gas such as nitrogen. The containers are provided with a discharge orifice which communicates with a distribution nozzle for the extinguishing agent. In such containers, the discharge orifice is closed by means of a frangible disc which is designed to withstand the high internal pressure of the container. In order to release the contents of the container into the ambient atmosphere, the disc must be destroyed and such destruction is customarily accomplished through the use of a highly active pyrotechnic separating element which has a hollow-charging effect. Thus, when a dangerous condition is sensed, the pyrotechnic separating element or other active detonator device will be energized to destroy the closing disc to thereby release the extinguishing agent.

The prior art extinguishing agent containers, as briefly described above, have several serious disadvantages. Firstly, since the containers are constantly under pressure, they are difficult to transport and installation and service exposes personnel to a dangerous working condition. Further, the effectiveness of the dispersion of extinguishing agent from such containers is somewhat limited because the pressure in the container drops sharply when the closing disc is destroyed.

SUMMARY OF THE INVENTION

The present invention overcomes the above briefly discussed and other deficiencies and disadvantages of the prior art and, in so doing, provides an extinguishing agent container which may be handled and transported with minimal danger. A container for an extinguishing agent or the like in accordance with the present invention is normally in an unpressurized state. The container is provided with a gas injection port to which an individual, locally disposed source of pressurized gas is coupled. The source of pressurized gas, in a preferred embodiment, comprises a gas generator which is responsive to an electrical command signal. The gas injection port is located and oriented so that a high pressure gas injected therethrough will impart swirling or cyclonic motion to the extinguishing agent in the container.

A container in accordance with the invention is also provided with an extinguishing agent discharge orifice, which will be coupled to a dispersion nozzle, and this orifice is closed by a pressure sensitive frangible disc. The disc is designed so that, at a relatively low pressure level, it will rupture upon the pressurization of the container via the gas injection port. The pressure level at which the disc will rupture is sufficiently below the maximum container pressure established by the gas source so that a high pressure level will be created and maintained within the container for a significant period of time after the extinguishing agent discharge orifice has been opened whereby a highly effective ejection of the extinguishing agent is obtained.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the figures and in which.

DESCRIPTION OF THE DISCLOSED EMBODIMENT

Figure 1:
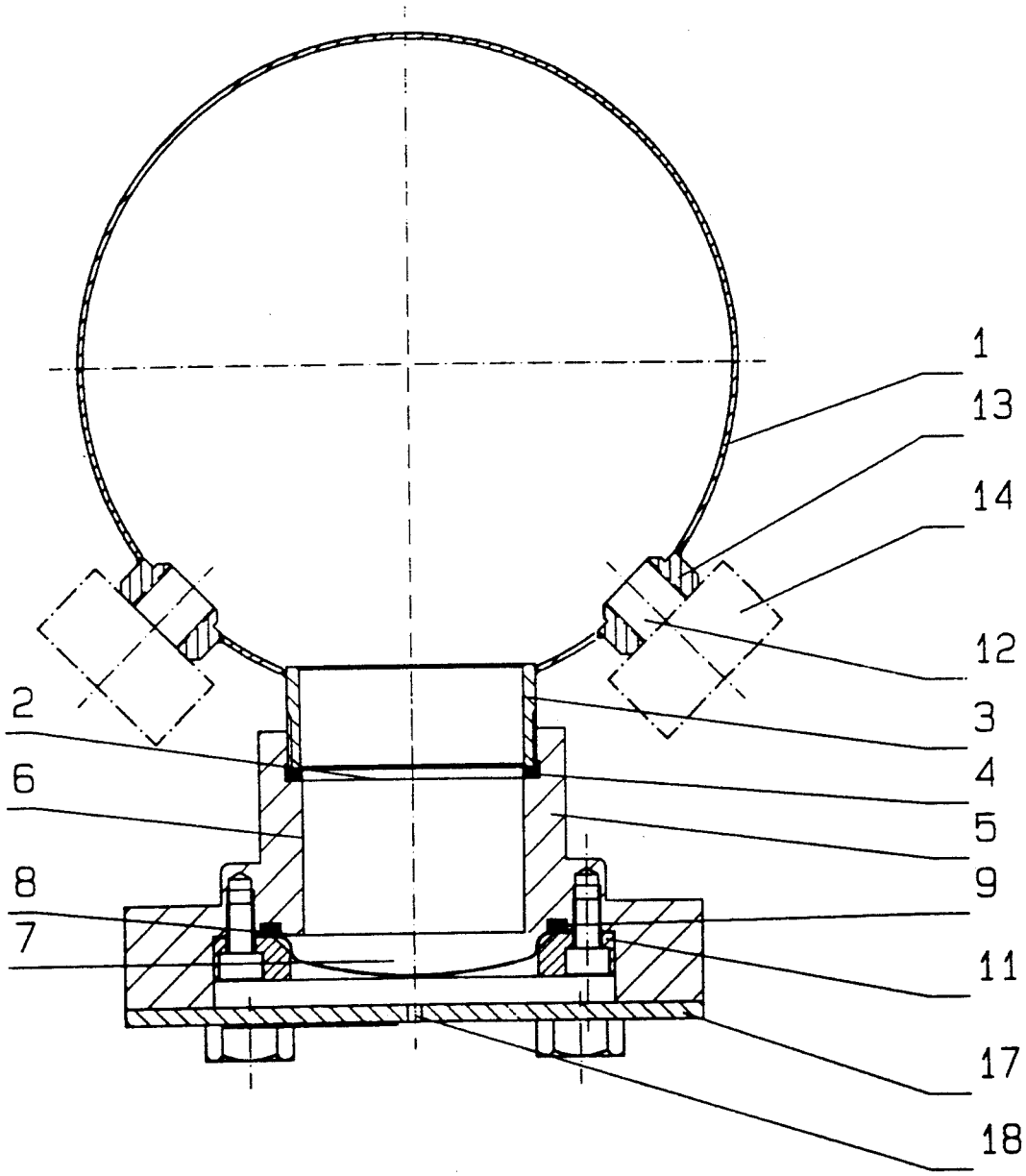
FIG. 1 is a cross-sectional side elevation view of a first embodiment of a container in accordance with the invention.

With reference now to the drawings, the container 1, which functions as a storage reservoir for the agent to be dispersed, is of generally spherical shape in the disclosed embodiment. Container 1 is provided, typically on the underside as the device is to be installed, with a connector 3 which, in part, defines an extinguishing agent discharge orifice or passage 2. Connector 3 is coupled, by means of complimentary external and internal threads for example, to a flange member 5. This coupling is made hermetic by the imposition of a sealing ring 4 between connector 3 and flange 5. In FIG. 1, the container is depicted as it would typically be configured for transportation. When the container is installed in its use environment, a dispersion nozzle, not shown, will be connected to the lower end of the flange 5.

Figure 2:
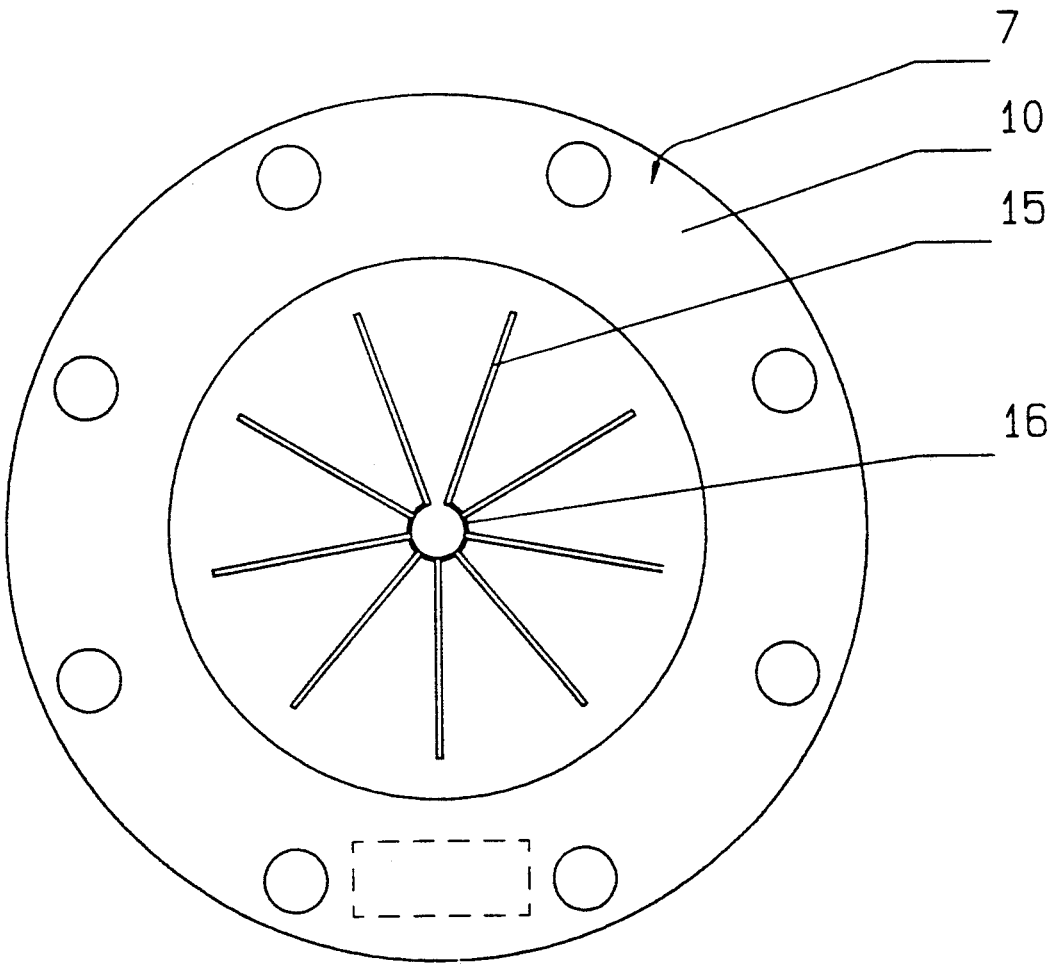
FIG. 2 is an enlarged top view of the frangible discharge orifice closing disc of the container of FIG. 1.

Continuing to discuss the disclosed embodiment, the flange 5 defines a bore 6 having an inner diameter which is equal to that of orifice 2 defined by connector 3. At its lower end, the flange 5 is provided with a portion of increased diameter defined in part by shoulder 8. A frangible disc 7, which normally establishes a hermetic seal between the inside of container 1 and the ambient atmosphere, is installed in the enlarged diameter portion of the bore of flange 5. The installation of disc 7, which has a shape which may best be seen from joint consideration of FIGS. 1 and 2, is accomplished by first installing a gasket 9 in an annular groove provided in shoulder 8. An edge portion 10 of the disc is brought into contact with the gasket 9, and the disc 7 is then captured in position. Gasket 9 is thereafter compressed, to provide a hermetic seal, by means of a retaining ring 11. The screws which hold retaining ring 11 in position pass through holes provided therefore in the edge portion 10 of disc 7 and are received in tapped holes provided in the flange 5.

The container 1 is shown as being provided with a pair of junction members 13 which define gas injection ports 12. The junction members 13 are intended to be mated with individual sources of pressurized gas such as the gas generators indicated in phantom at 14. In accordance with a preferred embodiment, the gas generators 14 are state-of-the-art devices which, in response to an electrical command signal, will cause the production of a highly pressurized propellant gas. Typically, the connection of the gas generators to the junction piece 13 will be by means of threaded fittings. The gas injection ports are arranged laterally in the lower region of the container 1, i.e., in the region of the container which will typically be occupied by the extinguishing agent. The axes of the bores 12 will be directed radially or obliquely upwards and will preferably also be offset so that the jets of injected gas will not directly intersect but will pass one another.

The gas generators 14 will, as noted, typically be responsive to electrical command signals which may be provided by appropriate detectors or by a central control and monitoring unit. When electrically triggered, the gas generators will cause a violent, i.e., very rapid, pressure-buildup within container 1; and this pressure buildup will, in the manner to be described below, cause the closing disc 7 to rupture. Rupture of disc 7 will permit the extinguishing agent to be delivered from container 1 to the ambient atmosphere via a nozzle affixed to the lower end of flange 5.

It is to be noted that the container 1 may be provided with one or several junction pieces 13 and associated gas generators. As a result of the oblique orientation of the axis or axes of the gas-injection port(s), a cyclone effect is exerted on the extinguishing agent by the injected gas, i.e., the extinguishing agent is entrained in a rotating or swirling flow of carrier gas. The extinguishing agent is thereby forcibly discharged through the orifice 2 defined by the connector 3. The effectiveness of the discharge of the extinguishing agent is enhanced by the use of at least two of the gas generators 14 and by having the gas jets provided thereby directed obliquely relative to one another and, if appropriate, additionally guided somewhat past one another. However, the desired cyclone effect can be achieved through the use of a single gas generator 14. The use of at least two gas generators obviously enhances security, i.e., the redundancy guards against a failure in the energization of one of the gas generators.

The capacity of the source or sources of pressurized gas which are connected to the junction piece(s) 13 is selected so that, after triggering, a predetermined pressure is maintained in container 1 for a predetermined period of time. In a preferred embodiment, a maximum pressure of approximately 60 bar is established for a time of approximately 200 ms.

In the disclosed embodiment, the disc 7 is, in the downstream direction, deepened outwardly in the middle region by approximately the width of the retaining ring 11, i.e., the disc 7 is concave in the direction of the applied pressure. The disc 7 is further provided, in the central region, with scoring which defines a series of parting or breaking lines 15, 16. The parting lines 15 extend in a star-shaped manner from the central circular parting line 16, parting line 16 being interrupted between a pair of the radially extending parting lines 15. The parting line 16, as shown, defines a circle having a relatively small diameter. The depth of the scoring and the thickness of the disc 7 are chosen so as to insure that the disc 7 will be ruptured at a preselected pressure and will open from the center outward forming triangular tabs. In accordance with the preferred embodiment, the pressure at which the disc 7 will rupture will be in the range of 0.1 to 1 bar.

The disc 7 must, of course, have sufficient strength to support the weight of the contents of the container when the container is in the unpressurized state, i.e., an extinguishing agent in liquid or solid form will exert a load on the disc 7. In this regard, it is to be noted that the extinguishing agent may comprise sand, water, a liquid which vaporizes when released, an extinguishing powder, etc.

For purposes of transportation, a plate 17 may be affixed to the lower end of flange 5 as shown in FIG. 1. The plate 17 will protect the disc 7 from damage. If the container 1 is to be transported with compressed gas generator(s) 14 or other suitable sources of pressurized gas already attached, the retaining plate 17 will be provided with a small bore 18 which will permit a controlled emission of extinguishing agent over a relatively long period of time in the case of inadvertent pressurization of container 1. The bore 18, accordingly, will function as a bleed hole and will guard against the creation of a high recoil moment which would impart movement to the container.

It should be noted that the gas injection ports 12 can also be closed by means of diaphragms, not shown, in order to permit the container 1 filled with extinguishing agent to be transported without sources of pressurized gas connected thereto. In such case, the gas sources, for example the gas generators 14, will be screwed into place at the use site, and the attachment of the gas generators to the junction pieces 13 will cause the rupture of such diaphragms.

It will be understood that the container 1, rather than being spherical as shown, may have an elongated shape such as, for example, a bottle-shape.

As will be obvious from the above discussion, the present invention enables the components of a fire or explosion suppression system to be transported and installed without significant danger to personnel since the container internal pressure used to destroy the disc 7 occurs only in the event of triggering.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a system for the selective release of an agent into the ambient environment, the system including a container for storing the agent and an orifice through which the stored agent may be ejected from the container under the influence of a pressurized propellent gas, the orifice defining a first axis, the system further including a frangible member which normally defines a hermetic seal for the orifice, the improvement comprising:

at least a pair of gas injection ports in a wall of the container each of said ports defining an axis which is inclined obliquely relative to said first axis;

a gas generator connected to each of said injection ports, said gas generators being disposed externally of the container and being responsive to electrical signals for generating a highly pressurized propellant gas to be delivered into the container, the position and said inclination of said obliquely inclined injection port axes resulting in a swirling flow pattern of agent within the container when said propellent gas is delivered into the container; and said frangible member comprising a pressure responsive disc, said disc being configured to rupture at a pressure which is less than the maximum pressure of the gas delivered into the container from said gas generators.

2. The system of claim 1 wherein the wall regions of the container disposed oppositely with respect to said ports have curved concave shapes at least in the regions where intersected by said port axes.

3. The system of claim 1 wherein said disc is scored along plural lines to define breaking points.

4. The system of claim 3 wherein said plural breaking points are arranged to cause the disc to burst in a star-shaped manner from the center.

5. The system of claim 1 wherein said gas generators have sufficient capacity to provide a pressure of at least 60 bar in the container and to maintain that pressure for at least 200 ms.

6. The system of claim 5 wherein said disc will rupture in response to establishment of a pressure in the container in the range of 0.1 to 1.0 bar.

7. In a system for the selective release of an agent into the ambient environment, the system including a container for storing the agent and an orifice through which the stored agent may be ejected from the container under the influence of a pressurized propellent gas, the orifice defining a first axis, the system further including a frangible member which normally defines a hermetic seal for the orifice, the improvement comprising:

at least a pair of gas injection ports in a wall of the container, each of each ports defining an axis which is inclined obliquely relative to said first axis, the axis of said ports also being obliquely oriented relative to one another;

a source of pressurized propellent gas connected to said injection ports, said gas source being disposed externally of the container and being responsive to an external signal for causing a pressurized propellent gas to be delivered into the container, the position and said inclination of said axes of said injection ports resulting in a swirling flow patter of agent within the container when said propellent gas is delivered into the container; and said frangible member comprising a pressure responsive disc, said disc being configured to rupture at a pressure which is less than the maximum pressure of the gas delivered into the container from said source.

8. The system of claim 7 wherein said source of pressurized gas comprises a gas generator, said gas generator being responsive to an electrical signal for generating a highly pressurized gas.

9. The system of claim 7 wherein the wall regions of the container disposed oppositely with respect to said ports have curved concave shapes at least in the regions where intersected by said port axes.

10. The system of claim 7 wherein said disc is scored along plural lines to define breaking points.

11. The system of claim 10 wherein said plural breaking points are arranged to cause the disc to burst in a star-shaped manner from the center.

12. The system of claim 7 wherein said pressurized propellant gas source has sufficient capacity to provide a pressure of at least 60 bar in the container and to maintain that pressure for at least 200 ms.

13. The system of claim 12 wherein said disc will rupture in response to establishment of a pressure in the container in the range of 0.1 to 1.0 bar.

* * * * *